United States Patent [19]

Grenfell

[11] Patent Number: 4,830,872

[45] Date of Patent: May 16, 1989

[54] ELECTROSTATIC COATING BLADE AND METHOD OF APPLYING A THIN LAYER OF LIQUID THEREWITH ONTO AN OBJECT

[75] Inventor: Julian P. Grenfell, Woking, United Kingdom

[73] Assignee: Sale Tilney Technology PLC, London, United Kingdom

[21] Appl. No.: 898,260

[22] Filed: Aug. 20, 1986

[30] Foreign Application Priority Data

Sep. 3, 1985 [GB] United Kingdom ..... 8521835
Sep. 6, 1985 [GB] United Kingdom ..... 8522144

[51] Int. Cl.[4] ..... B05D 5/00
[52] U.S. Cl. ..... 427/30; 118/626; 239/3; 239/690; 239/521
[58] Field of Search ..... 427/27, 30; 118/626, 118/629; 239/3, 6, 90, 708, 521, 690

[56] References Cited

U.S. PATENT DOCUMENTS

| | | | |
|---|---|---|---|
| 2,695,002 | 11/1954 | Miller | 118/626 |
| 2,782,074 | 2/1957 | Sedlacsik | 239/708 X |
| 2,860,599 | 11/1958 | Rice et al. | 118/626 |
| 3,486,483 | 12/1969 | Tilney et al. | 118/626 |
| 3,735,925 | 5/1973 | Benedek et al. | 427/27 X |
| 4,356,528 | 10/1982 | Coffee | 239/690 X |

FOREIGN PATENT DOCUMENTS 1335071 10/1973 United Kingdom .

OTHER PUBLICATIONS

Otterway et al., "Blades for Electrostatic Coating", International Application (PCT), Apr. 26, 1984, Publication No.: WO84/01524.
Noakes, et al., "Spraying Apparatus", European Patent Application No. 0194074, Sep., 10, 1986.

*Primary Examiner*—Shrive Beck
*Assistant Examiner*—Alain Bashore
*Attorney, Agent, or Firm*—Handal & Morofsky

[57] ABSTRACT

An electrostatic blade is disclosed having a slot extending the length of the blade and leading from a central duct to an outlet. A surface made of non-conductive material extends in front of the outlet and terminates in a discharge edge which is spaced 0.05 to 4 mm from the slot outlet. In use, liquid is passed from the duct along the slot to the outlet where it collects as a bead. An electrostatic field is applied between the liquid at the slot outlet and the object to be coated which draws liquid along the non-conductive surface in a tapering stream and further causing the liquid to be discharged from the edge. Because the stream of liquid reaching the discharge edge is very thin, very low liquid discharge rates can be achieved while still maintaining a uniform coating on the target object.

14 Claims, 2 Drawing Sheets

ELECTROSTATIC COATING BLADE AND METHOD OF APPLYING A THIN LAYER OF LIQUID THEREWITH ONTO AN OBJECT

BACKGROUND OF THE INVENTION

The present invention relates to an electrostatic coating blade for applying a thin layer of a liquid, e.g. oil, onto a target object; the present invention also provides a method of applying a coating of a liquid onto an object by elctrostatic spraying.

Electrostatic coating blades are well known for applying layers of paint or oil. One type of blade currently in use is made of metal and has a wedge shape that tapers to a discharge edge. A conduit extends longitudinally along the blade and a slot connects this conduit to the discharge edge for supplying liquid from the conduit to the discharge edge. When an electrostatic field of 50 to 140 kV is created between the object to be coated and the blade and when liquid, e.g. oil, is pumped along the conduit and through the slot, the field breaks up the liquid at the discharge edge into a number of conical streams which then in turn break up into charged droplets that are drawn by the field onto the object, which is thus covered in a thin liquid film. Using a blade of this type it is possible to achieve a minimum liquid discharge rate from the blade of approximately 0.5 ml/cm of blade per minute for a given oil but rates lower than this are not possible because, instead of steady conical streams, individual streams become intermittent which causes a discontinuous film on the object.

Attempts have been made to provide a uniform thin coating layer by limiting the amount of liquid fed to the discharge edge. One blade of this type is described in U.S. Pat. No. 2,695,002; the blade has a cylindrical body and a downwardly pointing lip extending along its length terminating in a discharge edge. A conduit extends along the length of the blade in which a rotor provided with a helical groove is located. As the rotor turns, liquid in the groove is fed into an outlet slot and from there the liquid flows onto the upper surface of the lip to form a thin stream that flows by the action of gravity to the discharge edge where it is discharged. The blade is usually made of steel but if the liquid is conductive, the blade may be made of an insulating material; however, the specification does not state how conductive a liquid must be to allow the blade to be made of insulating material. The width of the lip from the slot to the discharge edge is approximately 0.9 inches (23 mm). The minimum discharge rate of this blade necessary to produce a uniform coating on the target object is too high for the requirements of modern industry. Furthermore, since the blade relies on gravity to feed liquid from the slot to the discharge edge, the blade can only operate as a top blade, i.e. it can only coat objects located below it.

A further attempt to limit the amount of liquid reaching the discharge edge was to require liquid leaving a liquid outlet to flow over a surface towards the discharge edge under the action of gravity. A blade of this sort, which was produced commercially, is described in U.S. Pat. No. 3,486,483; the blade has a cylindrial body and a downwardly pointing lip that terminates in a discharge edge. The body is composed of an insulating material, while the lip has a sandwich construction with a conductive strip being located between two insulator layers; the edge of the strip is exposed near the discharge edge. The distance between the conductive strip and the discharge edge is approximately 10mm. A conduit extends along the length of the blade and exit holes are provided at the top of the cylindrical body so that liquid discharged from the exit holes flows over the outside of the body and onto the top surface of the lip; as the liquid stream flows over the cylindrical surface of the body and down the lip, it becomes thinner. When it reaches the discharge edge, the liquid stream is discharged at the discharge edge by virtue of the electrostatic field established between the object to be coated and the exposed edge of the conductive strip in the blade lip. However, the minimum discharge rate of this blade (while still producing a uniform coating on the target object) is still of the order of 0.5 ml/cm of blade length/minute; furthermore, since the flow of liquid between the outlet holes and the discharge edge depends on gravity, the blade can only be used as a top blade.

There is an increasing demand for a blade that can apply a thinner layer of liquid onto a target object while still requiring that the coating layer is continuous. This is particularly important in the steel industry where electrostatic coating blades are used to apply a layer of oil onto steel strip to prevent corrosion.

We have developed an electrostatic coating blade which has achieved application rates of oil as low as 0.03 ml/cm of blade length/per minute while still producing a uniform, continuous coating.

We have discovered that low discharge rates can be achieved by establishing an electrostatic field between the target object and the outlet(s) of one or more closed channels (by "closed" we mean that the channel has an inlet and an outlet but otherwise is not open to atmosphere) and placing an insulating surface in front of the channel outlets in such a way that a discharge edge provided at the end of the insulating surface is 0.5 to 4 mm from the channel outlets. In this way, liquid is drawn by the electrostatic field along the insulating surface in an ever tapering stream to the discharge edge and a very thin but uniform stream of liquid reaches the discharge edge where it is discharged evenly.

Summary

According to the present invention, there is provided an electrostatic coating blade for applying a coating of a non-conductive liquid onto an object, the blade comprising one or more liquid-conducting channels each extending to a channel outlet, means present at the or each outlet for applying an elecrostatic potential to liquid present at the outlet(s), a surface composed of non-conductive material located in front of the channel outlet(s) and a discharge edge at the end of the surface, wherein the distance between the discharge edge and the channel outlet(s) is in the range of from 0.5 to 4 mm.

The present invention also provides a method of operating the blade.

The liquid is drawn from the channel outlet(s) and along the surface under the influence of the applied electrostatic field as a film of gradually decreasing thickness and thus a consistent, thin film of liquid is supplied to the discharge edge leading to the formation at the discharge edge of a large number of small conical streams which are broken down by the electrostatic field into very small droplets that are drawn by the field to the target object. The droplets produced by the blade of the present invention are very much smaller than those produced by known blades and consequently uniform coatings can be obtained even at very low discharge rates. With this arrangement, application rates of the order of 0.03 cc/cm of blade/minute are possible. It may happen that before the film of liquid flowing along the surface reaches the discharge edge, it breaks up into several rivulets but this does not affect the operation of the blade because each rivulet in turn forms a conical stream at the discharge edge. Liquid can collect at the channel outlet(s) as a bead and liquid is drawn from the bead to the discharge edge by the electrostatic field (and to a small extent by surface tension). Thus there can be a gap between the liquid outlet(s) and the start of the non-conducting surface in which the liquid bead can collect.

The distance between the channel outlet(s) and the discharge edge at the end of the non-conducting surface is critical. If it is less than 0.5 mm, then there is insufficient distance to draw out the liquid into a fine stream and a low discharge rate cannot be achieved. When the distance is greater than 4 mm and the blade is pointing downwards, the stream breaks up and an uneven coating is obtained or the liquid is discharged straight from the channel(s); when the blade is pointing upwardly, the stream can stop completely. The optimum distance between the channel outlets and the discharge edge depends on the viscosity and resistivity of the oil, but it is generally 1 to 3 mm, e.g. approximately 2.5 mm.

It is important that the channel(s) leading up to the liquid outlet are closed since in this way liquid can be supplied to the liquid outlet consistently rather than relying on other factors, e.g. gravity, to supply the liquid. Also, since the channel(s) is/are closed, the blade can be used for coating objects above, below or to the side of the blade. Although more than one channel can be used for supplying liquid to the outlet, it is preferred that a single slot is used that extends along practically the entire length of the blade.

The blade of the present invention is primarily designed to apply oil and typically the liquid will have a resistivity of $5\times10^6$ to $3\times10^{10}$ ohm cm and preferably from $2\times10^7$ to $8\times10^8$ ohm cm.

It is preferred that the blade comprise two side pieces with the channel(s) being provided by a gap between them; such an arrangement is known per se. However, in the blade according to the invention, a first side piece can extend beyond the other side piece (the second side piece) so that the discharge edge and the surface leading to the discharge edge are provided on the first side piece. The first side piece can be made of non-conductive material; the second side piece can be made of similar material or it can be made of metal to provide the electrostatic charge to the liquid. The charge may alternatively be applied by a conductive wire or strip in the vicinity of the outlet(s). Preferably the two side pieces are slidable with respect to one another so as to adjust the distance between the discharge edge and the liquid outlet.

It is possible to adapt a known coating blade to form a blade in accordance with the present invention by extending one of the sides of the blade with a strip of non-conductive material so that the strip projects in front of the liquid outlet of the original blade. Thus, the extension provides the discharge edge of the modified blade and the non-conductive surface leading to it.

BRIEF DESCRIPTION OF THE DRAWINGS

The invention will be described in further detail, solely by way of example, with reference to the accompanying drawings, in which.

DESCRIPTION OF THE PREFERRED EMBODIMENT(S)

Figure 1:
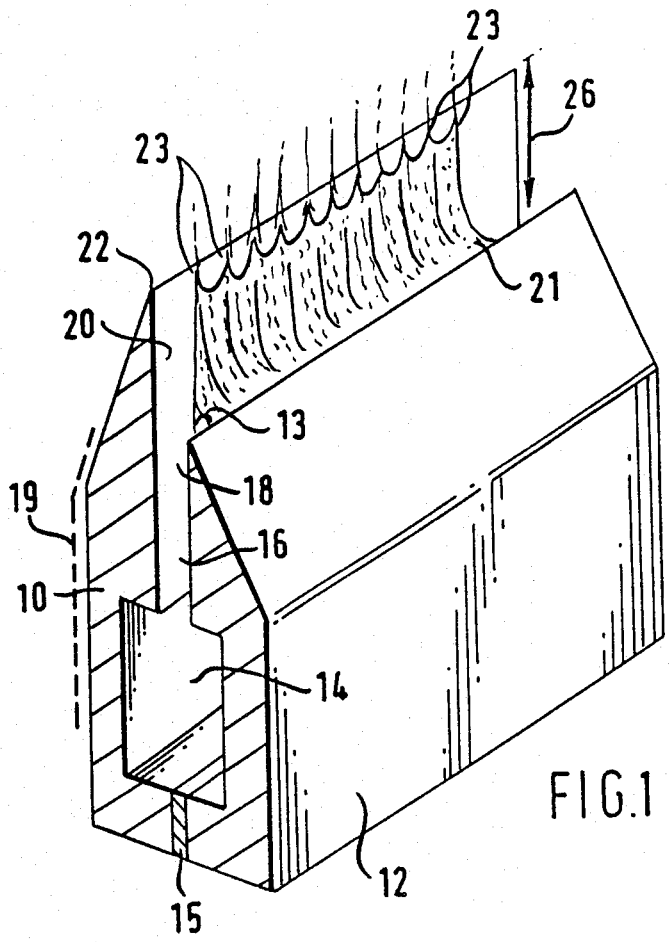
FIG. 1 is a perspective view of a sectional part of a blade in accordance with the present invention.

Referring initially to FIG. 1, a blade is shown having two side pieces 10 and 12, with a liquid conduit 14 being provided between them. The conduit runs along the length of the blade and is provided with liquid under pressure from a pump (not shown). A slot 16 is also provided between the side parts 10 and 12; the slot is between 120 and 380, e.g. 250, micrometres wide and receives liquid from the conduit 14 and conducts it to a liquid outlet 18, where the liquid collects as a bead 13. The width of slot 16 is determined by the width of a shim 15 and can be changed by changing the shim for one of different thickness. As can be seen, side piece 10 extends beyond side piece 12 and thus provides a surface 20 leading from the liquid outlet 18 to a discharge edge 22 at the end of side piece 10. The side pieces are held together by bolts (not shown) preferably the arrangement being such that the two side pieces can slide with respect to each other when the bolts are not fully tightened but, when fully tightened, the bolts clamp the side pieces and prevent any sliding movement. This arrangement allows the distance between discharge edge 22 and outlet 18 to be adjusted.

Figure 2:
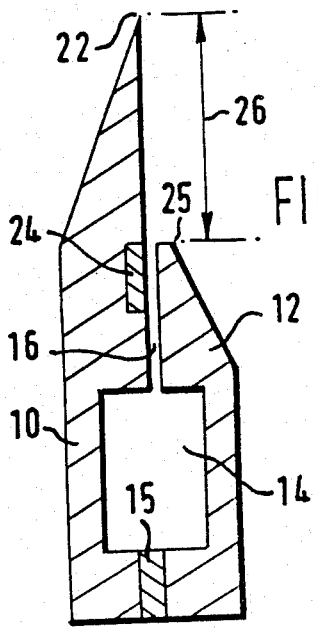
FIG. 2 is a transverse sectional view through a second blade in accordance with the present invention.

The side piece 10 is made of a non-conductive material, e.g. polymethylmethacrylate or an epoxy resin (Perspex or Tufnol, which are Trade Marks), ceramics or any other insulating material. The other side piece 12 may be made of metal, e.g. aluminium, and is connected to a high voltage source in order to supply electrostatic charge to the liquid at the outlet 18. Alternatively, side piece 12 may be made of a non-conductive material in which case there should be a conductive wire or strip in the slot 16 to provide charge to the liquid at the outlet 18. Such a strip is shown in FIG. 2 by the reference numeral 24 and is connected to a high voltage source; the strip is embedded in side piece 10 which is made of insulating material as is side piece 12. The strip 24 may equally be embedded in side piece 12 or a strip 24 may be embedded in both of side pieces 10 and 12. The strip 24 may be in the position shown or it may be located further down the slot 16. The distance 26 between the slot outlet 18 and the discharge edge 22 is between 0.5 and 4 mm, e.g. approximately 2.5 mm.

Referring to FIG. 1, when one side piece is conductive and the other side piece is non-conductive, an electrode 19 may be placed on or near the outer side of the non-conductive side piece 10 to counteract the field produced by the conductive side piece 12. If electrode 19 were not provided, the liquid might migrate and wet the outer surface of side piece 10. The electrode may be in the form of a conductive layer or plate attached to the side piece 10 or it may be a plate spaced slightly from the side piece 10.

Figure 3:
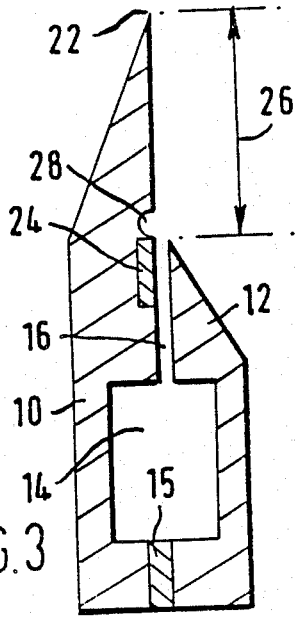
FIG. 3 is a transverse sectional view through a third blade in accordance with the present invention.

In operation, liquid collects at the outlet 18 as a bead of liquid 13 and is maintained there either by providing a flat surface 25 at the top of side piece 12 (see FIG. 2) or by providing a groove 28 in side piece 10 in which the liquid can accumulate as shown in FIG. 3. A strip of conductive material 24 may be provided within or below the groove 28 to supply electrostatic charge to the liquid.

Figure 4:
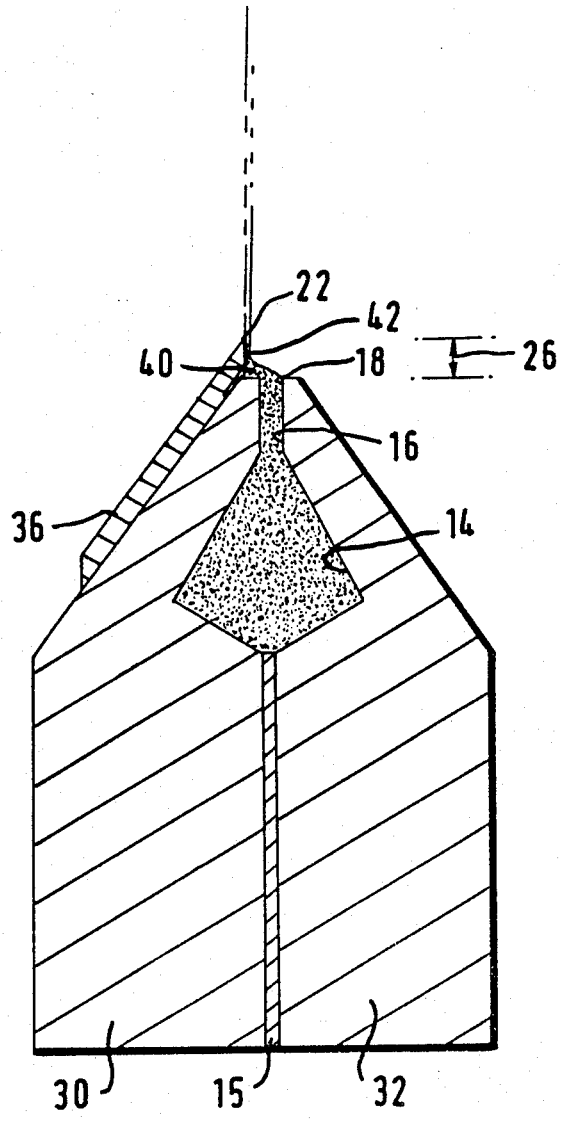
FIG. 4 is a transverse sectional view through a fourth blade in accordance with the present invention.

The blade shown in FIG. 4 has two side pieces 30 and 32 both made of aluminium and a spacing shim 15 located between them. A liquid conduit 14 extends along practically the whole length of the blade and a single slot 16 is provided for conducting the liquid from conduit 14 to an outlet 18. The width of slot 16 is determined by the width of the shim 15. A strip 36 of 1.5 mm thick Tufnol (Trade mark), which is an insulating material, is secured to the outer surface of blade side piece 30 and extends so that a leading edge 22 of the strip lies in front of the outlet 18. The distance 26 between the slot outlet 18 and the leading (or discharge) edge 22 is approximately 2.5 mm.

The blades shown in FIGS. 1 to 3 operate as follows: liquid is supplied under slight pressure to conduit 14 and it flows along slot 16 to outlet 18 where it collects as a bead 13. An electrostatic field is established between the blade and the object to be coated usually by holding the object at earth potential and charging the blade up to the working potential of 50 to 120 kV. This potential is supplied to side piece 12 when it is conductive or to strip 24 when sidepiece 12 is non-conductive. The liquid is thereby also charged. As shown in FIG. 1, the electrostatic field draws the liquid 21 from the outlet 18 to the discharge edge 22. The liquid stream flowing along edge 22 and it may actually be formed into distinct rivulets 23 as shown in FIG. 1 or it may reach the edge 22 as a single stream. In either case, only a small amount of liquid reaches the discharge edge, where it is atomised. The discharge is constant even at low discharge rates.

The operation of the blade shown in FIG. 4 is very similar to the operation of the blades shown in FIGS. 1 to 3. Electrostatic charge is applied to the liquid at the outlet via the side piece 30 and/or 32, the liquid collects as a bead 40 at the outlet 18 but that bead does not extend as far as discharge edge 22. Liquid from the bead is accelerated under the influence of the applied electrostatic field along surface 42 of the strip 36 until it reaches the leading edge 22 where it is discharged. As it is drawn along surface 42 by the electrostatic field, the liquid forms a film of decreasing thickness and in this way, very small discharge rates of liquid can be achieved as described above.

Although the blade has been described primarily in an operaton in which very small amounts of liquid are discharged, the baldes can also be operated to provide much higher discharge rates.

The blade according to the present invention is primarily designed to coat objects with oil to protect them from corrosion but it may also be used to apply any liquid that is customarily applied by electrostatic coating techniques.

EXAMPLE

An electrostatic coating blade as shown in FIG. 4 was used to coat an object with Nalco oil (type XL 174) having a resistivity $6.5\times10^7$ hm cms at 35° C. The target object is held at earth potential and the blade is charged to a negative potential of 90 kV. The insulating strip is made of 6F45 Tufnol (Tufnol is a Trade Mark) which is an epoxy resin containing a fine weave fabric. The target object is located 9 inches (23 cms) from the blade. A discharge rate of 0.03 ml/cm of blade length/minute was obtained while still producing a uniform, continuous coating of the oil. The voltage was then increased to 120 kV and the rate of liquid supply to the blade was increased. Using these parameters, a discharge rate of 15 ml/cm of blade length/minute was obtained.

A blade as illustrated in U.S. Pat. No. 2,695,002 was used to coat a similar object with XL 174-type Nalco oil; the minimum discharge rate that could be obtatined was 0.5 ml/cm of blade length/minute but even at this rate, the object had uncoated patches caused by the fact that the blade produced large droplets. In order to provide a coating of the same degree of uniformity as the blade of the present invention operating at a discharge rate of 0.03 ml/cm of blade length/minute, the blade of U.S. Pat. No. 2,695,002 required a discharge rate of 1.2 ml/cm of blade length/minute, i.e. 40 times that required by the present invention. The maximum discharge rate that could be obtained from the blade of U.S. Pat. No. 2,695,002 was 6 ml/cm of blade length/minute; at higher rates, liquid is discharged from areas of the blade in addition to the discharge edge and this leads to an unsatisfactory uneven coating.

It is clear from the above that the blade of the present invention can be used over a much wider range of discharge rates than the blade illustrated in U.S. Pat. No. 2,695,002.

I claim:

1. An electrostatic coating blade for applying a coating of a liquid onto an object, the blade comprising at least one liquid conducting channel extending to an associated channel outlet, means present in and at each outlet for applying an electrostatic potential to liquid present at the outlet(s), a surface composed of a non-conductive material located in front of the channel outlet(s) and a discharge edge forming an end of the

2. A blade as claimed in claim 1, wherein the distance between the channel outlet(s) and the discharge edge is in the range of from 1 to 3 mm.

3. A blade as claimed in claim 1, wherein the distance between the channel outlet(s) and the discharge edge is approximately 2.5 mm.

4. A blade as claimed in claim 1, which includes a conduit extending along the length of the blade and wherein the or each channel extends between the conduit and said channel outlet.

5. A blade as claimed in claim 1, wherein the blade is composed of first and second halves, the said channel(s) extending between the two halves and the said first half being composed of an insulating material and terminating in the said discharge edge and also extending beyond the second half to provide said non-conductive surface between the channel outlet(s) and the discharge edge.

6. A blade as claimed in claim 5, wherein the said second half is composed of an insulating material.

7. A blade as claimed in claim 5, wherein the said second half is composed of a conductive material.

8. A blade as claimed in claim 7, wherein the first half has an outer coating of a conductive material.

9. A blade as claimed in claim 1, wherein the means for applying an electrostatic potential to liquid present at the outlet(s) is a metal strip located in the or each channel in the vicinity of the outlet thereof.

10. A blade as claimed in claims 1, wherein the blade is composed of two conductive halves between which the channel(s) extend and a strip of insulating material extends in front of the channel outlet(s), the said non-conductive surface and the said discharge edge being formed on the said insulating strip.

11. A blade as claimed in claim 1, wherein the insulating surface is composed of a material selected from the group consisting of a polycarbonate, a ceramics material, a polymethylmethacrylate and an epoxy resin.

12. A method of applying a coating of a liquid onto an object using an electrostatic coating blade to which the liquid is fed, the blade comprising one or more channels each extending to a channel outlet and a surface made of non-conductive material located in front of the channel outlet(s) and terminating in a discharge edge, the discharge edge being located 0.5 to 4 mm from the channel outlet(s), wherein the method comprises supplying liquid to the channel outlet(s), applying an electrostatic potential to liquid in and at the channel outlet(s) and establishing an electrostatic field between the liquid at the channel outlet(s) and the object to be coated, thereby causing a stream of reducing thickness to be drawn towards the discharge edge and further causing liquid to be discharged from the discharge edge onto the object.

13. A method as claimed in claim 12, wherein liquid collects as a bead at the liquid outlet(s).

14. An electrostatic coating blade for applying a coating of a liquid onto an object, the blade comprising at least one liquid conducting slot extending to a slot outlet, means present in and at the slot outlet for applying an electrostatic potential to liquid present at the outlet, a surface composed of non-conductive material located in front of the slot outlet and a discharge edge forming an end of the surface, wherein there is a distance between the slot outlet and the discharge edge in the range of from 1.0 to 4 mm.

* * * * *

UNITED STATES PATENT AND TRADEMARK OFFICE

CERTIFICATE OF CORRECTION

PATENT NO. : 4,830,872

DATED : May 16, 1989

INVENTOR(S) : GRENFELL, Julian P.

It is certified that error appears in the above-identified patent and that said Letters Patent is hereby corrected as shown below:

Claim 1 should read as follows:

1. An electrostatic coating blade for applying a coating of a liquid onto an object, the blade comprising at least one liquid conducting channel extending to an associated channel outlet, means present in and at each outlet for applying an electrostatic potential to liquid present at the outlet(s), a surface composed of a a non-conductive material located in front of the channel outlet(s) and a discharge edge forming an end of the surface, wherein there is a distance between the channel outlet(s) and the discharge edge in the range of from 0.5 to 4 mm.

Signed and Sealed this

Twenty-seventh Day of February, 1990

*Attest:*

JEFFREY M. SAMUELS

*Attesting Officer* *Acting Commissioner of Patents and Trademarks*